United States Patent [19]

Johansson

[11] Patent Number: 4,809,368

[45] Date of Patent: Mar. 7, 1989

[54] SHOWER AND BATH TUB

[76] Inventor: Arne H. V. Johansson, Farstorp, S-241 00 Eslöv, Sweden

[21] Appl. No.: 173,550

[22] Filed: Mar. 25, 1988

[30] Foreign Application Priority Data

Mar. 30, 1987 [SE] Sweden ..... 8701312

[51] Int. Cl.[4] ..... A47K 3/022

[52] U.S. Cl. ..... 4/540; 4/579

[58] Field of Search ..... 4/540, 546, 559, 589, 4/590, 579

[56] References Cited

U.S. PATENT DOCUMENTS 3,924,278 12/1975 Ekman ..... 4/540

FOREIGN PATENT DOCUMENTS 2029211 3/1980 United Kingdom .

*Primary Examiner*—Edward L. Roberts

*Attorney, Agent, or Firm*—Foley & Lardner, Schwartz, Jeffery, Schwaab, Mack, Blumenthal & Evans

[57] ABSTRACT

A shower and bath tub is adjustable into an upwardly inclined position (A), whereby the tub has a seat (35) on which a person (41) may sit when the tub is in its upwardly inclined position. The seat has two sitting surfaces (36*a*, 37*a*) on opposite sides of a forwardly open space (38). In order to prevent faeces from the person sitting on the seat from ending up in the tub, and prevent showering water when showering the abdomen of said person to gather in the tub and/or flow out on the floor, the space (38) may receive a basin (42), which is removable from the space, for collecting faeces from said person (41), and communicates with an output (50) which may be opened to permit discharge of showering water flowing down through the space from the tub (1) when said tub is in its upwardly inclined position (A) and the abdomal parts of a person sitting on the sitting surfaces are showered by means of the shower (64).

17 Claims, 10 Drawing Sheets

SHOWER AND BATH TUB

The present invention relates to a shower and bath tub which is adjustable into an upwardly inclined position, wherein a fore foot end is at a substantially lower level than a rear head end to permit entrance and stepping out from the tub through the fore foot end, whereby the tub has a seat and a back rest portion behind said seat, on which seat a person may sit when the tub is in its upwardly inclined position, whereby the seat has two sitting surfaces on opposite sides of a forwardly open space and whereby the tub is tippable backwards from the upwardly inclined position to a horizontal position to permit bathing in the tub in a reclined position, whereby the space between the sitting surfaces of the seat extends backwards to the back rest portion or to the proximity thereof, and whereby a shower is provided on or at the tub.

Tippable bath tubs are already known from U.S. Pat. No. 3,924,278, GB-A-2 029 211 and the brochure "The Clinaré Bath". All of these tubs are adjustable into an upwardly inclined position, wherein it is possible to step into and out of the tub. From the upwardly inclined position, the tubs may be tipped backwards to a more horizontal position for bathing. However, these prior art tubs do not permit or are at least not adapted for efficient collection of faeces from a person sitting in the respective tub before said faeces end up in the tub. Neither is it possible to shower the abdomen of the person in the tub without very contaminated showering ring water gathering at the bottom of the tub and/or flowing out on the floor.

The object of the present invention is to eliminate these drawbacks and provide a shower and bath tub wherein faeces may be collected before said faeces end up in the tub and wherein showering water from showering the abdomen of a person can not gather in the tub and/or flow out on the floor. This is arrived at according to the invention while said shower and bath tub has obtained the characterizing features of claim 1.

While the space between the sitting surfaces of the seat has room for a basin which is removable from the tub, faeces from the person sitting on the sitting surfaces may be collected before ending up in the tub. While the space is further communicating with an outlet which is openable to permit water when showering the abdomen of a person to flow out of the tub, the showering water is prevented from gathering in the tub and/or from flowing out on the floor. These properties of the shower and bath tub are essential, since for hygienic reasons it is absolutely necessary to prevent gathering of faeces and/or showering water in the tub as well as preventing such showering water—eventually containing faeces—from flowing out on the floor.

The invention will be further described below with reference to the accompanying drawings, in which FIG. 1 is a perspective view of a shower and bath tub according to the invention;

Figure 1:
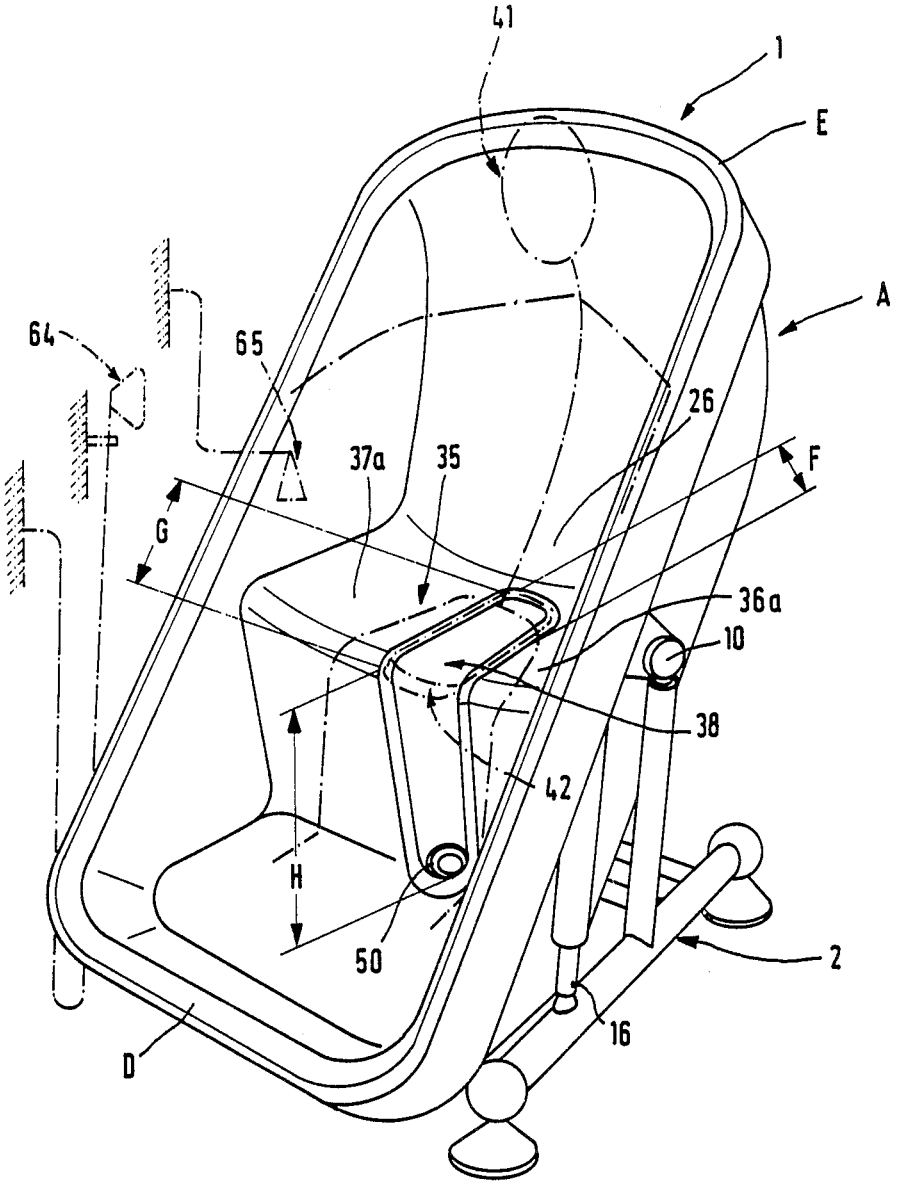
Figure 2:
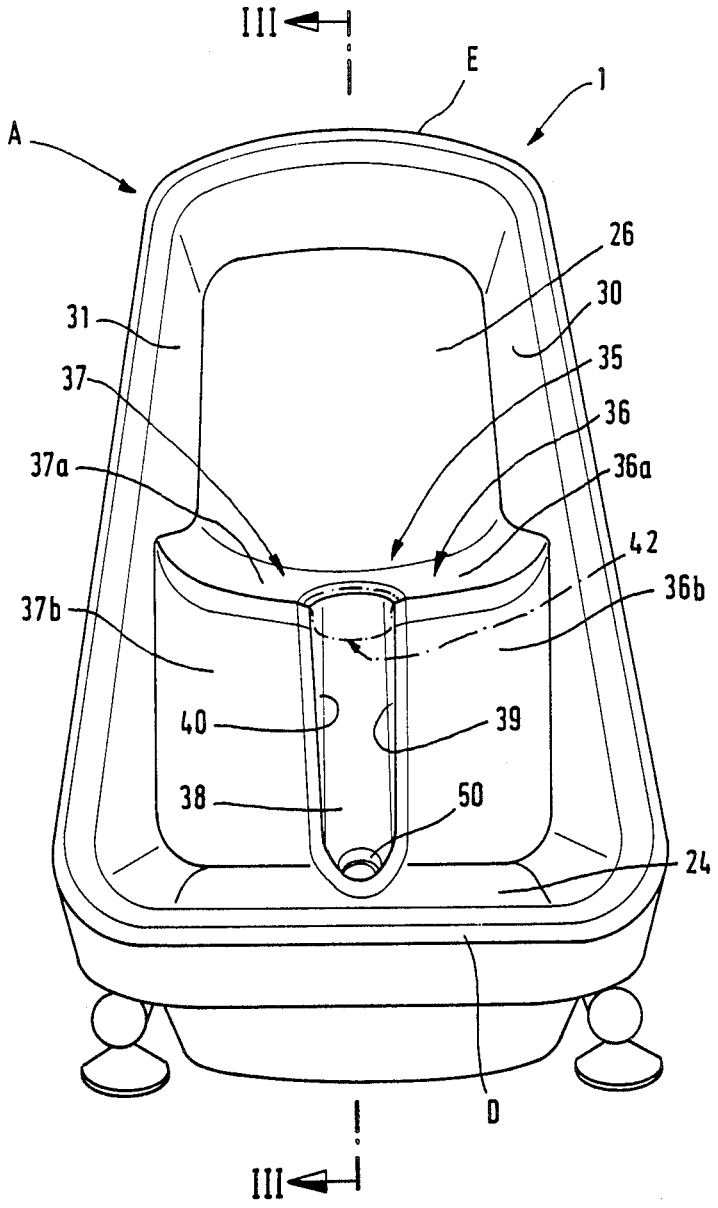
FIG. 2 is a front view of the shower and bath tub of FIG. 1.
Figure 3:
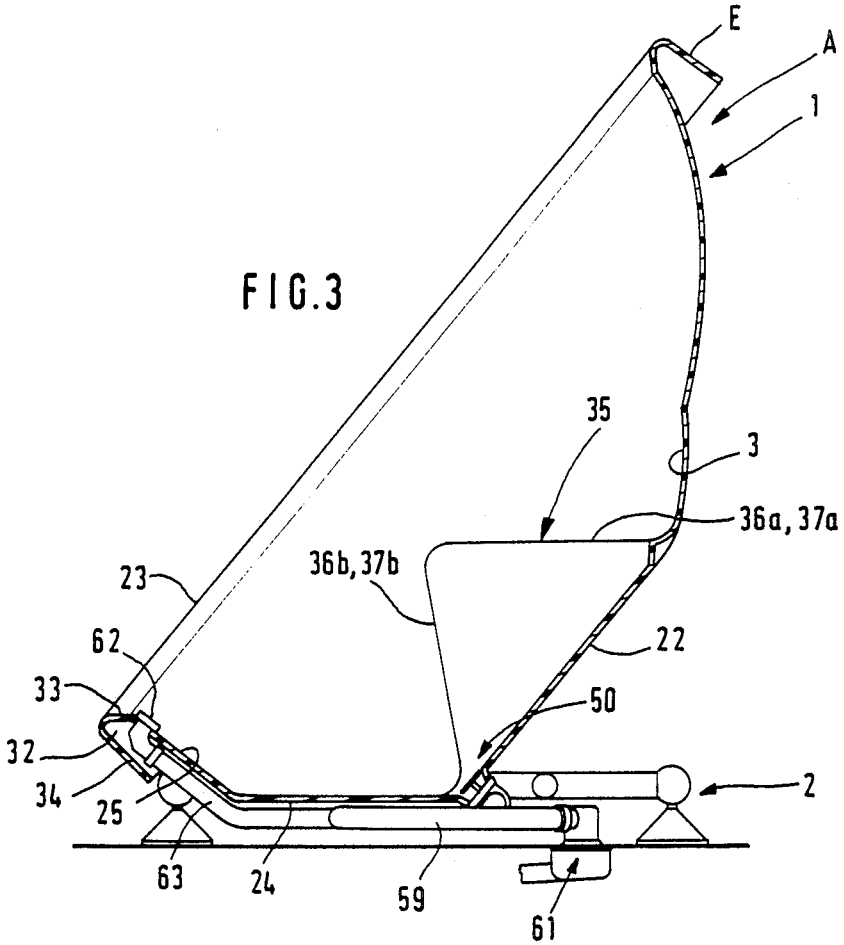
FIG. 3 is a section along line III—III in FIG. 2.
Figure 4:
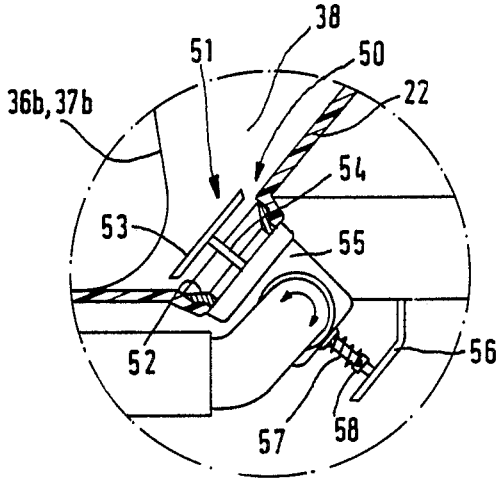
FIG. 4 is a section through a valve in the shower and bath tub of FIG. 3.
Figure 5:
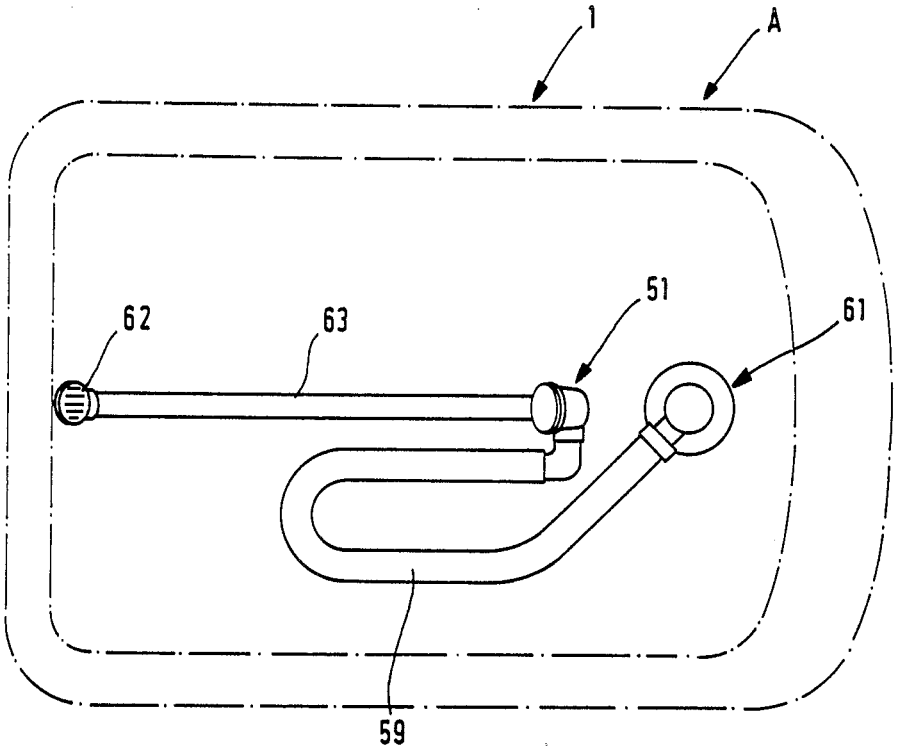
FIG. 5 is a plan view of the shower and bath tub of FIG. 3, whereby the outer profiles of the tub are only indicated by dashed and dotted lines, while drainage hoses under the tub are marked in full lines.
Figure 6:
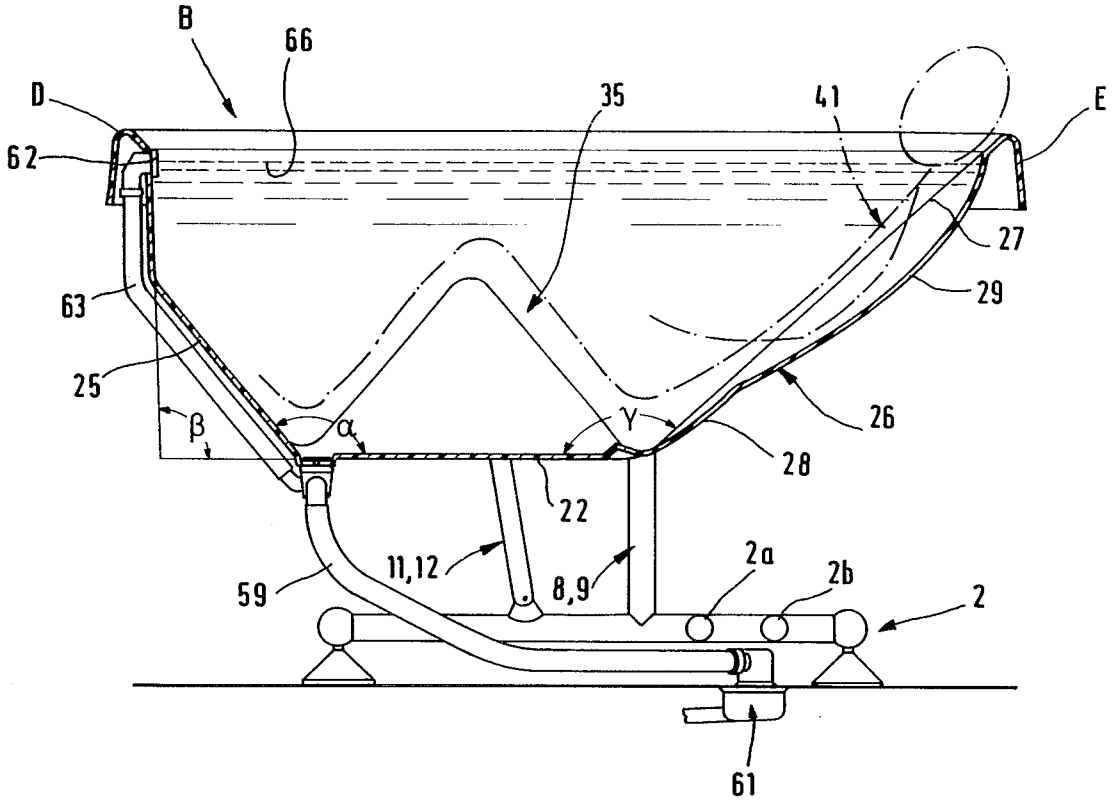
FIG. 6 is a section through the shower and bath tub in bathing position.
Figure 7:
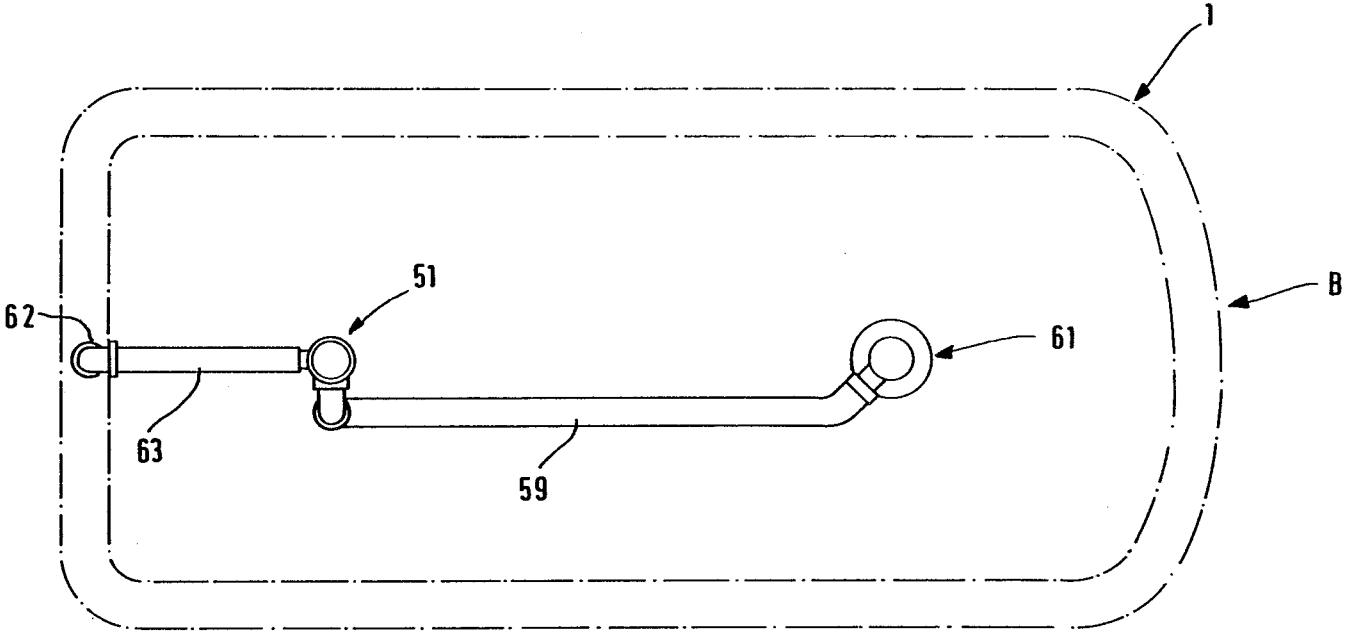
FIG. 7 is a plan view of the shower and bath tub of FIG. 6, whereby the outer profiles of the tub are indicted only by dashed and dotted lines while the drainage hoses under the tub are marked in full lines.
Figure 8:
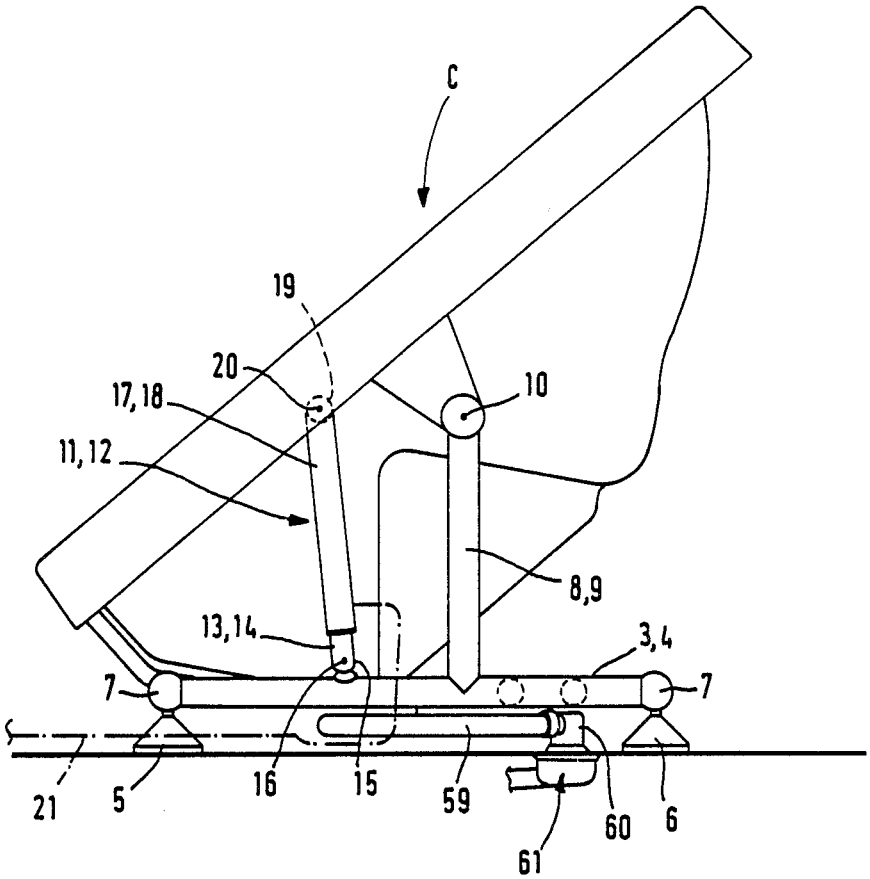
FIG. 8 is a side view of the shower and bath tub of FIG. 1 in position for a foot bath.

The shower and bathing plant illustrated in the drawings comprises a shower and bath tub 1 and a frame 2 including two longitudinal tubes 3 and 4 which are connected to each other through two transverse tubes 2a, 2b and which each has two support means 5 and 6, whereby each support means 5 and 6 respectively, is articulated to a bracket 7 in such a way that the support means can adapt to the indination of the around on which the shower and bath tub 1 stands. On each frame tube 3, 4 there is provided a vertically directed column 8 and 9 and on top of each column, the shower and bath tub 1 is pivotally journalled about a horizontal pivot axis 10. On each frame tube 3, 4 there is also provided, in front of each column 8, 9 a hydraulic aggregate 11, 12 for pivoting the shower and bath tub between an upwardly inclined position A and a horizontal position B. The hydraulic aggregates are also adapted to maintain the shower and bath tub 1 in the upwardly inclined position A (FIG. 1, 2 or 3), the horizontal position B (FIG. 6) and an intermediate position C (FIG. 8). Each hydraulic aggregate 11, 12 consists of a cylinder/piston device in which the piston 13 through a bearing 15 is pivotally journalled on the respective frame tube 3, 4 for pivoting about a horizontal pivot axis 16. The shower and bath tub 1 is mounted on top of the cylinders 17, 18 of said cylinder/piston devices, through bearings 19, in such a manner that it is pivotable about a horizontal pivot axis 20 relative to the cylinder/piston devices. The hydraulic aggregates are operated preferably by water under pressure and are therefore connected to a conventional water work system through hoses 21 schematically illustrated with dashed and dotted lines. Since such hydraulic aggregates are already known regarding their construction and function, they are not described in more detail.

The shower and bath tub 1 consists of, in the embodiment shown, a plastic body manufactured in one piece in a mold. In large, the shower and bath tub 1 has a bottom wall 22 extending parallel and substantially parallel with the upper edge 23 of the tub. Towards the foot end D of the tub 1, the bottom wall 22 transforms into a foot support wall 24 directed upwards towards the upper edge 23 and extending at an angle$\alpha$ of 110°–130° relative to the bottom wall. On top, the foot support wall 24 transforms into a front wall 25 extending at an angle $\beta$ of about 90° or a somewhat larger angle relative to the bottom wall 22. Towards the head end E of the tub 1, the bottom wall 22 transforms into a back rest portion 26 extending saggingly along a line 27 inclining upwards from the bottom wall 22 to the upper portions of the head end E and running at an angle $\gamma$ of 125°–140° relative to the bottom wall. Closest to the bottom wall 22, the back rest portion 26 has a less sagging part 28 which transforms into a sagging part 29 of substantially greater length and depth than the part 28. The part 28 forms about 25% of the length of the back rest portion 26 and the part 29 the remaining 75%. The bottom wall 22, foot support wall 24, front wall 25 and back rest portion 26 transform into side walls 30, 31 and all said walls transform on top into an edge portion 32 running around the tub 1 and formed by a portion 33 inclining upwards/outwards from said walls and transforming into a downwardly directed portion 34.

The tub 1 comprises a seat 35 defined by two wall portions 36, 37 positioned on opposite sides of the bottom wall 22, protruding into said tub. The wall portion 36 provides one sitting surface **36*a* of the seat 35 and a wall portion 36*b* extending from said surface to the foot support wall 24. The wall portion 37 forms the other sitting surface 37*a* of the seat 35 and the wall portion 37*b* extending from said other surface to the foot support wall 24. Seen sideface, each wall portion 36, 37 and the bottom wall 22 forms a substantially/isosceles triangle, wherein the bottom wall is the base and the sitting surfaces 362, 37*a* and wall portions 36*b*, 37*b*** the sides.

Since the wall portions 36, 37 protrude somewhat over half the height of the tub 1 between the bottom wall 22 and the upper edge 23, a deep space 38 is provided between the wall portions 36, 37 and this space is limited down below by the bottom wall 22 and by two vertical side portions 39, 40 extending downwards from the sitting surface **36*a* and wall portion 36*b* and the sitting surface 37*a* and wall portion 37*b*** respectively, to the bottom wall.

The space 38 has such a width F that a person 41 can sit comfortably on the seat 35 with both bottom members on the sitting surfaces **36*a*, 37*a*. Furthermore, the space has such a length G that it extends to the back rest portion 26 or at least to the proximity thereof. This means that the person 41 or any personnel is able to shower and/or wash the abdominal parts of the person when said person has assumed the most comfortable sitting position, i.e. is sitting so far in on the seat 35, that the person is supported by the back rest portion 26 by leaning the back against it. It is essential to be able to shower/wash the abdominal parts of the person 41** sitting on the seat in this way, since hereby, it is also possible to treat weak or in other ways handicapped persons who can not or who have difficulties in sitting up without support of the back.

Since the space 38 except for a substantial length G also has a substantial depth H, it also has room for a removable basin 42 for collecting faeces from the person 41. The space 38 is designed to permit positioning of the basin adjacent to the back rest portion 26, whereby the basin may be placed under the bottom members of the person when these members are disposed in the proximity of the back rest portion 26. The depth H of the space 38 provides room for a basin 42 of sufficient depth K for containing so much faeces that this normally can not flow over.

Figure 9:
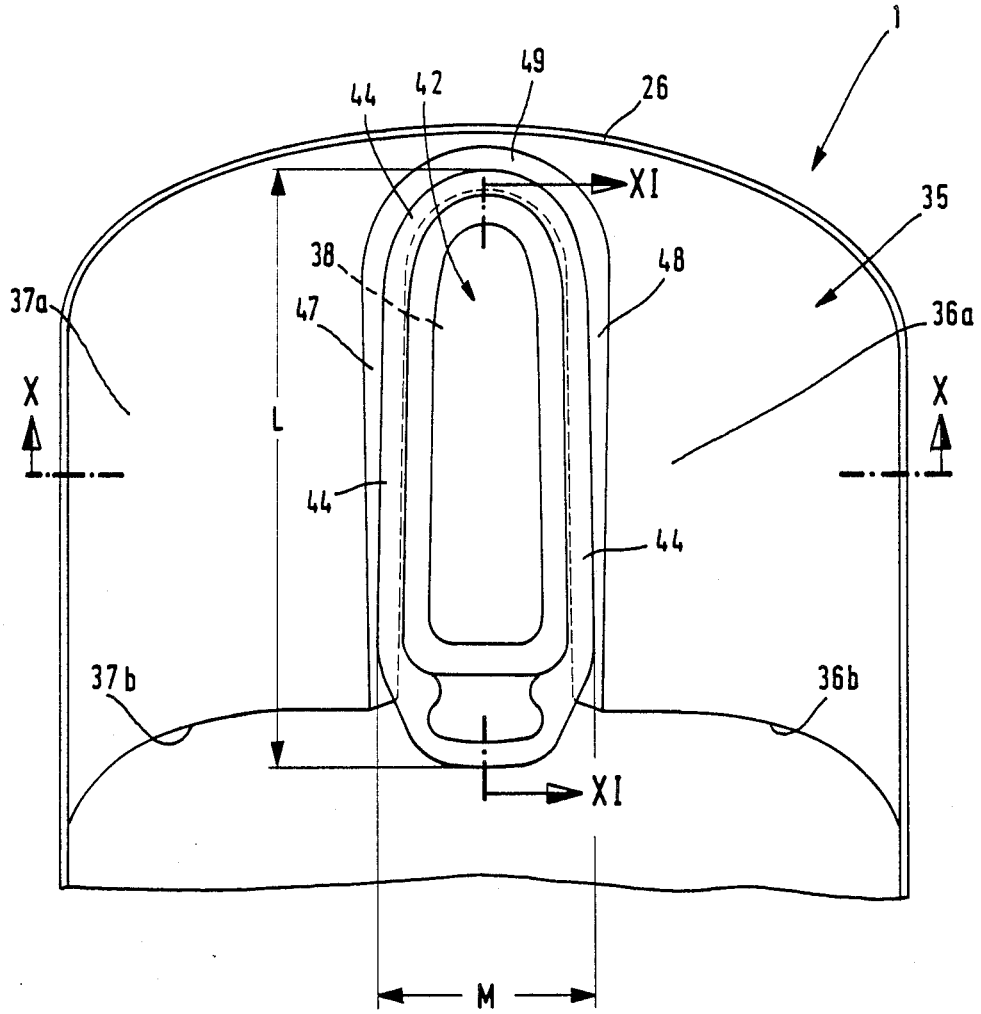
FIG. 9 is a plan view of a sitting portion of the shower and bath tub of FIG. 1, whereby a schematically illustrated basin is positioned at said sitting portion.
Figure 10:
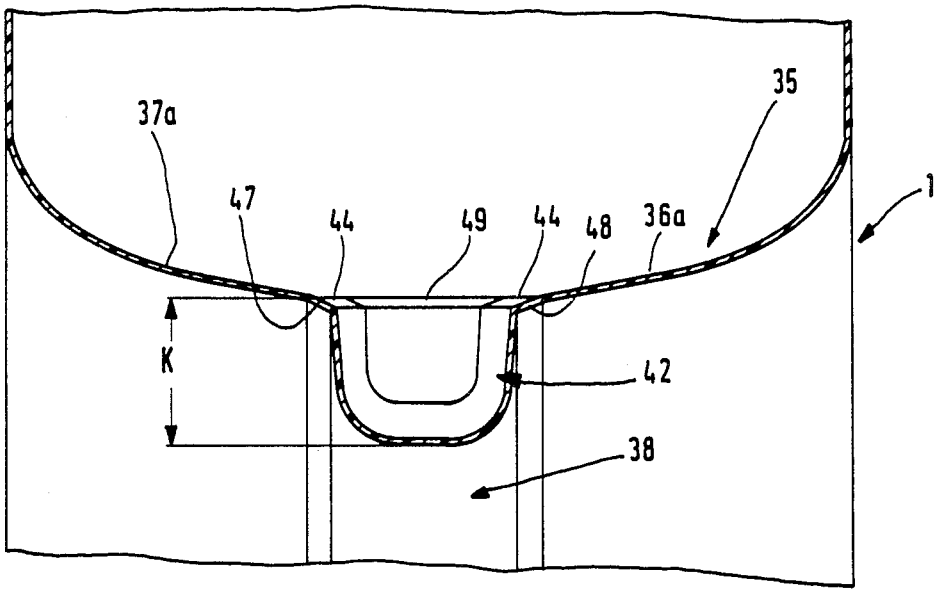
FIG. 10 is a section along line X—X in FIG. 9.
Figure 11:
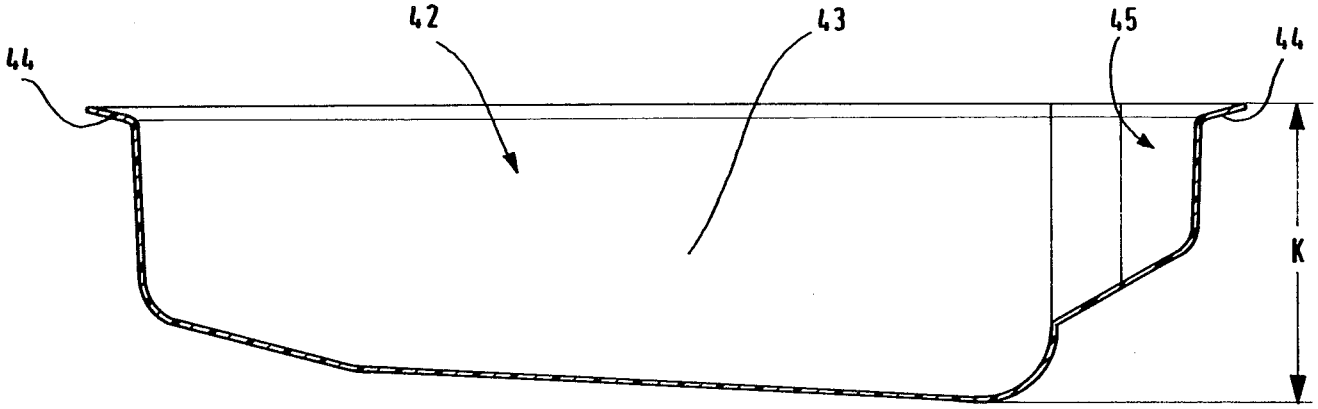
FIG. 11 is a section along line XI—XI in FIG. 9.

The basin 42 is of longitudinal shape, is preferably made of a plastic material and disposable or eventually intended for reuse. The basin consists of a collecting bowl 43 which on top, around said bowl is provided with an upwardly/outwardly extending suspension edge 44, and of a handle portion 45 at one end. The length L of the basin 42 is greater than half the length of the space 38 and preferably somewhat longer than the space 38 as is shown in FIG. 9 The width M of the basin 42 somewhat exceeds the width F of the space 38. While the basin 42 has said length L, it will cover the space 38 in its entire length, which means that the basin 42 can collect faeces irrespective of how far in the person 41 sits on the seat. Furthermore, the handle portion 45 will be situated outside the open front side of the space 38, which means that one can insert and remove the basin 42 from the space without difficulty and eventually, if desired, without touching the person. Since the basin 42 is somewhat wider than the space 38, it may be suspended on the sitting surfaces **36*a*, 37*a* of the seat 35 via the suspension edge 44. Preferably, the sitting surfaces 36*a*, 37*a* have longitudinal countersunk edge portions 47 and 48 respectively, closest to the space 38 and these countersunk edge portions may connect to each other through an also countersunk edge portion 49 extending adjacent to the parts of the space closest to the back rest portion 26. The edge portions 47–49 have such a depth that the upper side of the basin 42 and particularly of the suspension edges 44 will lie beneath the level of the sitting surfaces 36*a*, 37*a* closest to the space 38 when the basin is positioned in said space and the suspension edges engage the edge portions from above. Hereby, the basin 42 may be inserted into and removed from the space 38 without the risk of pinching or in any other way hurt the bottom of the person 41**.

In order to discharge water from the tub 1, said tub comprises an outlet 50 provided on a transition portion between the bottom wall 22 and the foot support wall 24. This means that the outlet 50 is positioned in direct connection with the space 38 and at least a large amount of waste water from showering/washing of the abdominal parts of the person 41 can flow directly down into the outlet 50 through the space 38 without flowing out onto the foot support wall 24. Parts of waste water anyway flowing out onto the foot support wall 24 will however, without difficulty, also flow down into the outlet 50.

A valve 51 is provided in the outlet 50. This valve is provided to ensure that the outlet is open when the tub is in its upwardly inclined position A, such that showering and washing water from showering or washing of the abdomen will not collect in the tub 1 but flow out. The valve 51 is also provided to automatically close the outlet when the tub 1 is tipped backwards towards its horizontal position B. For this purpose, the valve 51 includes a valve seat 52 and a valve body 53 above said seat, said valve being mounted on a valve stem 54. The valve stem is displaceably mounted in a valve housing 55 and protrudes sealingly down through the bottom of the valve housing 55. A lifting means 56 is provided on the frame 2 and positioned such that it lifts the valve stem 54 and thus, the valve body 53 away from the valve seat 52 when the tub 4 is tipped forwards from the horizontal position B to the upwardly inclined position A. A return spring 57 is threaded onto the valve stem 56 and positioned between the valve housing 55 and an engaging means 58 mounted on the valve stem 54 and engaged by said return spring. The return spring 57 has such a length that it is compressed when the lifting means 56 lifts the valve stem 54 and returns the vale stem and thus, the valve body 53 to the valve seat 52 by stretching when the tub is tipped backwards towards its horizontal position B, whereby the outlet 50 is automatically closed and is kept closed until the tub is once again tipped forwards to its upwardly inclined position A. A discharge conduit 59 is rotatably connected to the valve housing 55 and also connected to an inlet member 60 of a draining gutter 61, which inlet member is rotatably mounted on the draining gutter. While both end portions of the discharge conduit 59 are rotatably mounted, the tub 1 may be tipped without said conduit resisting the tipping movement.

The tub 1 also comprises a spillway 62 provided on top of the front wall 25. The spillway 62 and its discharge conduit 63 to the valve housing 55 are dimensioned to provide such a capacity that so much water is discharged per time unit that the water is prevented from flowing over the foot end D when the tub is tipped forwards from the horizontal position B to the upwardly inclined position A.

In use, the tub 1 is set in its upwardly inclined position A, whereby a person 41 easily can step into the tub via the foot end D thus resting at a low level. Thereafter, the person 41 stands on the foot support wall 24, turns around, eventually while holding in the edges of the tub or in a handle (not shown) on or adjacent the tub, and sits down on the seat 35 preferably so far in that he sits comfortably and can lean the back against the substantially vertically upwardly directed back rest portion 26. Thereafter, the person can shower or be showered by means of the hand shower 64 provided on or beside the tub. When showering and washing the abdominal parts of the person and/or other parts of the body, the tub 1 and particularly its head end provide an efficient shower screen preventing splashing of water. After showering and washing, the tub 1 may be tipped backwards to the horizontal position B and this tipping is controlled by the person or personnel by means of a control (not shown) permitting increase of the pressure in the hydraulic aggregates 11, 12. Thus or thereafter, water is filled into the tub 1 by means of a water tap 65 provided on or beside the tub.

The tub 1 has such a height and can be filled to the spillway 62 to such a water level 66 that the bathing person can lay down in a relaxed position with the shoulders under the water surface 66. Hereby, the back rest portion 26 provides a good support for the person-s back, the sitting surfaces 36*a*, 37*a* prevent the person from gliding down under the water surface 66, the wall portions 36*b*, 37*b* provide good support for the calf of the person's legs and the foot support wall 24 provides excellent support for the person's feet.

After bathing, the tub is tipped forwards from the horizontal position B to the upwardly inclined position A and this is achieved by setting the above mentioned control for reduction of the pressure in the hydraulic aggregates 11, 12. While the tub is suspended on the columns 8, 9 in such a way that the horizontal axis 10 is situated substantially closer to the head end E than the foot end D, it is guaranteed that the tub is automatically tipped forwards to its upwardly inclined position A because of its own weight and the weight of the water therein. The forward tipping movement may be adjusted by successively lowering the pressure in the hydraulic aggregates and/or successively discharging liquid from the hydraulic aggregates-11, 12. Hereby, it is guaranteed that the tub 1 is not tipped forwards faster than that the spillway 62 is capable of swallowing so much water that the water does not flow over the foot end D.

The tub 1 may also be set in the foot bathing position C (FIG. 8) by being tipped somewhat backwards from the upwardly inclined position A. Hereby, the tub 1 is tipped only to such an extent that the valve 51 loses the outlet 50. Thereafter, water may be filled into the tub 1 until the water level reaches the spillway 62, which is at a substantially lower level than the sitting surfaces 36*a*, 37*a*. Thus, the raising of water is limited to a suitable level such that the feet may be held in water and without difficulty lifted out of said water for washing. After the foot bath, the water may be discharged by tipping the tub 1 forwards to the upwardly inclined position A, whereby the valve 51 is opened.

The toilet function of the tub 1 may be utilized before or after showering and/or bathing and eventually also during showering, whereby one preferably controls that too much water does not flow down into the basin 42. The basin 42 may be placed in the space 38 before the person 41 sits down on the seat or be inserted into position when the person already sits on the seat 35. The basin 42 may be removed by drawing it forwards out of the space 38 when the person 41 already sits on the seat 35 or by drawing or lifting it away when the person 41 has left the seat 35.

The invention is not limited to the embodiment illustrated in the drawings and described above, but may vary within the scope of the following claims. As an example of different areas of utility one can mention nursing institutions, but it may also be used at home, and as an example of alternative embodiments one can mention that the tub may be of another material than plastic, that another frame may be used and that the tub may be tipped by other aggregates than hydraulic aggregates. Furthermore, the seat may be of another design and may consist of elements which are removably mounted in the tub, and this also applies for the back rest portion. This portion extends preferably in vertical direction when the tub is in its upwardly inclined position and due to the depth of the tub, said tub provides an efficient shower screen when a person wants to shower the upper body. The sitting surfaces of the seat and the wall portions extending therefrom towards the foot support wall define seen from the side, an angle of preferably 90° or somewhat less. The space between the sitting surfaces does not need to be so deep and/or long as indicated in the drawings, and the sitting surfaces may preferably in an arcuate shape transform into the side walls of the tub. The length of the tub relative to the depth thereof is about 5:2, but other ratios between length and depth are possible.

The outlet valve my be of another type than illustrated and be controlled in another way.

The basin is preferably disposable, but may be of a type intended for reuse and be of another length, width and depth than what is shown in the drawings.

The frame preferably includes transverse tubes under the head end and the longitudinal tubes thereof are situated at such a distance from each other that the foot end of the tub may be tipped down therebetween.

The tub may include various controls (not shown) and taps and hand shower, but such devices may alternatively be mounted at another location. Furthermore, there may be fixed shower nozzles-at-suitable locations in the tub.

The frame is preferably so designed that the tub, in the horizontal position, is situated at a suitable level for enabling the personnel to manage the bathing person without leaning down in an improper way.

Finally, it should be mentioned that the tub may normally be used as a shower and/or bath tub and in such case no basin is used. However, the tub may at any time be brought about to show a toilet function by placing the basin in the space in view. Thereafter, the tub can once again be rearranged by removing the basin.

I claim:

1. Shower and bath tub which is adjustable into an upwardly inclined position (A), wherein a fore foot end (D) is at a substantially lower level than a rear head end (E) to permit entrance and stepping out from the tub (1) through the fore foot end, whereby the tub has a seat (35) and a back rest portion (26) behind said seat, on which seat a person (41) may sit when the tub is in its upwardly inclined position, whereby the seat has two sitting surfaces (36*a*, 37*a*) on opposite sides of a forwardly open space (38) and whereby the tub is tippable backwards from the upwardly inclined position (A) to a horizontal position (B) to permit bathing in the tub in a reclined position, whereby the space (38) between the sitting surfaces (36*a*, 37*a*) of the seat (35) extends backwards to the back rest portion (26) or to the proximity thereof, and whereby a shower (64) is provided on or at the tub (1), characterized in that the space (38) may receive a basin (42), which is removable from the space, for collecting faeces from the person (41) sitting on the sitting surfaces (36*a*, 37*a* and communicates with an outlet (50) which may be opened to permit discharge of showering water flowing down through the space from the tub (1) when said tub is in its upwardly inclined position (A) and the abdominal parts of a person sitting on the sitting surfaces are showered by means of the shower (64).

2. Shower and bath tub according to claim 1, characterized in that the space (38) and the basin (42) are designed to permit placing of the basin in parts of the space adjacent to the back rest portion (26).

3. Shower and bath tub according to claim 1, characterized in that the basin (42) has a length (L) which exceeds at least half the length (G) of the space (38) and is preferably somewhat longer than said space and that the basin has a width (M) which somewhat exceeds the width (F) of the space.

4. Shower and bath tub according to claim 1, characterized in that the sitting surfaces (36*a*, 37*a*) closest to the space (38) has countersunk edge portions (47, 48, 49), that the basin (42), adapted to be placed in the space, has outwardly directed suspension edges (44), that the basin is provided to hang on the sitting surfaces by letting the suspension edges thereof engage the countersunk edge portions of the sitting surfaces from above, and that the countersunk edge portions of the sitting surfaces and the suspension edges of the basin are designed such that said suspension edges of the basin are situated beneath the parts of said sitting surfaces closest to the space when the basin is suspended on said sitting surfaces.

5. Shower and bath tub according to claim 1, characterized in that the seat (35) comprises an edge portion (49) between the space (38) and the back rest portion (26), on which edge portion a part of the basin (42) is suspendable.

6. Shower and bath tub according to claim 1, characterized in that the basin (42) is of a disposable type.

7. Shower and bath tub according to claim 1, characterized in that the tub (1) includes a bottom wall (22) which extends parallel to or substantially parallel to an upper edge (23) of the tub and which defines the bottom of the space (38), that the seat (35) consists of two wall portions (36, 37) which on opposite sides of the space protrude from the bottom wall towards the upper edge, and that each wall portion (36 and 37 respectively) defines a sitting surface (36*a* and 37*a* respectively) projecting from the back rest portion (26) and a wall portion (36*b* and 37*b* respectively) extending substantially perpendicular to said sitting surface and connecting to a foot support wall (24)

8. Shower and bath tub according to claim 7, characterized in that the bottom wall (22) and the two wall portions (36, 37) defining the seat (35), seen side-face, have the shape of an isosceles triangle, wherein said wall portions constitute sides extending at an angle of substantially 90° relative to each other.

9. Shower and bath tub according to claim 7, characterized in that a foot support wall (24) extends from the bottom wall (22) towards the foot end (D) of the tub (1) at an angle ($\alpha$) of 110°–130° relative to said bottom wall and that the back rest portion (26) protrudes from the bottom wall towards the head end (E) of the tub and extends saggingly along a line (27) running at an angle ($\gamma$) of 125°–140° relative to the bottom wall.

10. Shower and bath tub according to claim 1, characterized in that the space (38) extends down to an outlet (50).

11. Shower and bath tub according to claim 1, characterized in that the outlet (50) comprises a valve being provided to keep the outlet open when the tub is in its upwardly inclined position (A) for showering and/or washing the abdominal parts of the person (41), in order to discharge water from the tub at showering and/or washing of the abdomen, and that the valve is provided to close the outlet in order to collect water in the tub for washing the feet of a person sitting on the seat.

12. Shower and bath tub according to claim 11, characterized in that the valve (51) is provided to open the outlet (50) and keep it open by lifting said valve from a closing position to an opening position when it rams into a lifting means (56) on a frame (2) to the tub (1) while said tub is tipped to the upwardly inclined position (A).

13. Shower and bath tub according to claim 1, characterized in that a spillway (62) is provided at the foot end (D) of the tub (1), said spillway having sufficient capacity to discharge so much water from the tub that the water is prevented from flowing over the foot end of the tub when said tub is tipped forwards from the horizontal position to the upwardly inclined position.

14. Shower and bath tub according to claim 1, characterized in that a spillway (62) is provided to be situated at a substantially lower level than the sitting surfaces (36*a* 37*a*) when the tub is in its upwardly inclined position in order to limit the raising of water when water is filled into the tub for foot bathing.

15. Shower and bath tube according to claim 1, characterized in that the tub (1) is mounted on a frame (2) comprising two longitudinal tubes (3, 4), that each tube includes a column (8, 9) on which the tub is pivotally mounted, that each tube also includes a hydraulic aggregate (11, 12) for tipping the tub, that said longitudinal tubes are connected to each other under the head end (E) of the tub through one or more transverse tubes (2*a*, 2*b*) and that the distance between the longitudinal tubes under the head end of the tub is greater than the width of the tub such that said tub may be tipped down between said longitudinal tubes.

16. Shower and bath tub according to claim 1, characterized in that the tub (1) has such a depth and may be filled to such a level in the horizontal position (B) that the person (41) bathing can lay with the shoulders under the water surface.

17. Shower and bath tub according to claim 1, characterized in that the tub (1) is suspended such that it is automatically set in the upwardly inclined position (A).

* * * * *